US010352674B2

(12) United States Patent
Eitschberger

(10) Patent No.: US 10,352,674 B2
(45) Date of Patent: Jul. 16, 2019

(54) PIVOTABLE BULKHEAD ASSEMBLY FOR CRIMP RESISTANCE

(71) Applicant: DynaEnergetics GmbH & Co. KG, Troisdorf (DE)

(72) Inventor: Christian Eitschberger, München (DE)

(73) Assignee: DynaEnergetics GmbH & Co. KG, Troisdorf (DE)

( * ) Notice: Subject to any disclaimer, the term of this patent is extended or adjusted under 35 U.S.C. 154(b) by 0 days.

(21) Appl. No.: 16/156,339

(22) Filed: Oct. 10, 2018

(65) Prior Publication Data

US 2019/0049225 A1 Feb. 14, 2019

Related U.S. Application Data

(60) Continuation of application No. 16/056,944, filed on Aug. 7, 2018, which is a division of application No. 15/612,953, filed on Jun. 2, 2017, now Pat. No. 10,066,921, which is a division of application No. 15/068,786, filed on Mar. 14, 2016, now Pat. No. 9,784,549.

(Continued)

(51) Int. Cl.
*F42D 1/05* (2006.01)
*F42D 1/04* (2006.01)

(52) U.S. Cl.
CPC ..... *F42D 1/05* (2013.01); *F42D 1/043* (2013.01)

(58) Field of Classification Search
CPC ..... F42D 1/05; F42D 1/043
USPC ..... 439/100
See application file for complete search history.

(56) References Cited

U.S. PATENT DOCUMENTS 2,296,346 A 9/1942 Hearn
2,439,394 A 4/1948 Lanzalotti et al.
(Continued)

FOREIGN PATENT DOCUMENTS

GB 2544247 A 5/2017
WO WO-2015006869 A1 1/2015
(Continued)

OTHER PUBLICATIONS

Canadian Intellectual Property Office, Office Action for CA App. No. 2923860 dated Jul. 14, 2017, which is in the same family as U.S. Appl. No. 15/612,953 and U.S. Appl. No. 15/068,786, 3 pages.
(Continued)

*Primary Examiner* — Alexander Gilman
(74) *Attorney, Agent, or Firm* — Moyles IP, LLC

(57) ABSTRACT

According to an aspect a bulkhead assembly is provided having particular application with a downhole tool, in particular for oil well drilling applications. The bulkhead assembly includes a bulkhead body and an electrical contact component disposed within the bulkhead body, wherein at least a portion of the electrical contact component is configured to pivot about its own axis, without compromising its ability to provide a pressure and fluid barrier. In an embodiment, a ground apparatus is provided to provide an electrical connection for at least one ground wire. The ground apparatus may be positionable on the bulkhead body of the bulkhead assembly. In an aspect, a downhole tool including the bulkhead assembly and ground apparatus is also generally described.

20 Claims, 11 Drawing Sheets

Related U.S. Application Data

(60) Provisional application No. 62/134,893, filed on Mar. 18, 2015.

(56) References Cited

U.S. PATENT DOCUMENTS

| | | | | |
|---|---|---|---|---|
| 3,892,455 | A | 7/1975 | Sotolongo | |
| 4,346,954 | A | 8/1982 | Appling | |
| 4,411,491 | A | 10/1983 | Larkin et al. | |
| 4,660,910 | A | 4/1987 | Sharp et al. | |
| 4,859,196 | A | 8/1989 | Durando et al. | |
| 5,083,929 | A | 1/1992 | Dalton | |
| 5,358,418 | A * | 10/1994 | Carmichael | E21B 17/028 166/65.1 |
| 5,392,851 | A | 2/1995 | Arend | |
| 5,529,509 | A | 6/1996 | Hayes et al. | |
| 5,558,531 | A | 9/1996 | Ikeda et al. | |
| 5,679,032 | A | 10/1997 | Auclair | |
| 5,759,056 | A | 6/1998 | Costello et al. | |
| 5,765,962 | A | 6/1998 | Cornell et al. | |
| 5,769,661 | A | 6/1998 | Nealis | |
| 5,797,761 | A | 8/1998 | Ring | |
| 5,927,402 | A | 7/1999 | Benson et al. | |
| 6,297,447 | B1 | 10/2001 | Burnett et al. | |
| 6,315,461 | B1 * | 11/2001 | Cairns | G02B 6/3816 385/139 |
| 6,582,251 | B1 * | 6/2003 | Burke | H01R 13/5202 439/589 |
| 6,772,868 | B2 | 8/2004 | Warner | |
| 6,902,414 | B2 * | 6/2005 | Dopf | E21B 17/028 439/140 |
| 6,976,857 | B1 | 12/2005 | Shukla et al. | |
| 7,182,611 | B2 | 2/2007 | Borden et al. | |
| 7,237,626 | B2 * | 7/2007 | Gurjar | E21B 17/028 166/65.1 |
| 7,364,451 | B2 | 4/2008 | Ring et al. | |
| 7,553,078 | B2 | 6/2009 | Hanzawa et al. | |
| 7,748,447 | B2 | 7/2010 | Moore | |
| 7,980,874 | B2 | 7/2011 | Finke et al. | |
| 8,387,533 | B2 | 3/2013 | Runkel | |
| 8,910,718 | B2 | 12/2014 | Watson et al. | |
| 9,145,764 | B2 | 9/2015 | Burton et al. | |
| 9,518,443 | B2 | 12/2016 | Tunget | |
| 9,570,897 | B2 | 2/2017 | Dobrinski et al. | |
| 9,634,427 | B2 | 4/2017 | Lerner et al. | |
| 9,784,549 | B2 | 10/2017 | Eitschberger | |
| 9,874,083 | B2 | 1/2018 | Logan et al. | |
| 10,036,236 | B1 | 7/2018 | Sullivan et al. | |
| 2005/0186823 | A1 | 8/2005 | Ring et al. | |
| 2009/0301723 | A1 * | 12/2009 | Gray | E21B 23/00 166/301 |
| 2012/0247771 | A1 | 10/2012 | Black et al. | |
| 2016/0084048 | A1 | 3/2016 | Harrigan et al. | |
| 2017/0138150 | A1 | 5/2017 | Yencho | |
| 2017/0314373 | A9 | 11/2017 | Bradley et al. | |

FOREIGN PATENT DOCUMENTS

| | | | |
|---|---|---|---|
| WO | WO-2015028204 | A2 | 3/2015 |
| WO | WO-2015134719 | A1 | 9/2015 |

OTHER PUBLICATIONS

Canadian Intellectual Property Office, Office Action for CA App. No. 2923860 dated Nov. 25, 2016, which is in the same family as U.S. Appl. No. 15/612,953 and U.S. Appl. No. 15/068,786, 3 pages.

Burndy, Bulkhead Ground Connector, Mechanical Summary Sheet, The Grounding Superstore, Jul. 15, 2014, 1 page, https://www.burndy.com/docs/default-source/cutsheets/bulkhead-connect.

DJResource, Replacing Signal and Ground Wire, 5/012007, 2 pages, http://www.djresource.eu/Topics/story/110/Technics-SL-Replacing-Signal-and-Ground-Wire/.

Jim Gilliat and Khaled Gasmi, New Select-Fire System, Technical Presentation, Baker Hughes, 2012, 16 pages, http://www.perforators.org/wp-content/uploads.

Owens Oil Tools, E & B Select Fire Side Port Tandem Sub Assembly, Dec. 2012, 9 pgs., https://www.corelab.com/owen/CMS/docs/Manuals/gunsys/MAN-30-XXX-0002-96-R00.pdf.

DynaEnergetics, Through Wire Grounded Bulkhead (DynaTWG). May 25, 2016, 1 pg., https://www.dynaenergetics.com/uploads/files/5756f884e289a_U233%20DynaTWG%20Bulkhead.pdf.

Chinese Office Action for CN Appl. No. 201610153426.X, which is in the same family as U.S. Appl. No. 16/156,339 dated Mar. 20, 2019, 6 pgs.

* cited by examiner

PIVOTABLE BULKHEAD ASSEMBLY FOR CRIMP RESISTANCE

CROSS-REFERENCE TO RELATED APPLICATIONS

This application is continuation patent application of U.S. application Ser. No. 16/056,944 filed Aug. 7, 2018, which is a divisional patent application of U.S. application Ser. No. 15/612,953 filed Jun. 2, 2017, which is a divisional patent application of U.S. application Ser. No. 15/068,786 filed Mar. 14, 2016, which claims the benefit of U.S. Provisional Application No. 62/134,893 filed Mar. 18, 2015, each of which is incorporated herein by reference in its entirety.

FIELD

Described generally herein is a bulkhead assembly having a pivotable electric contact component for use with a downhole tool, that is, any piece of equipment that is used in a well.

BACKGROUND

In exploration and extraction of hydrocarbons, such as fossil fuels (e.g. oil) and natural gas, from underground wellbores extending deeply below the surface, various downhole tools are inserted below the ground surface and include sometimes complex machinery and explosive devices. Examples of the types of equipment useful in exploration and extraction, in particular for oil well drilling applications, include logging tools and perforation gun systems and assemblies. It is often useful to be able to maintain a pressure across one or more components, (that is, to provide a "pressure barrier"), as necessary to ensure that fluid does not leak into the gun assembly, for instance. It is not uncommon that components such as a bulkhead and an initiator are components in such perforating gun assemblies that succumb to pressure leakage.

Upon placement into the perforating gun assembly, one or more initiators, (typically a detonator or an igniter), have traditionally required physical connection of electrical wires. The electrical wires typically travel from the surface down to the perforating gun assembly, and are responsible for passing along the surface signal required to initiate ignition. The surface signal typically travels from the surface along the electrical wires that run from the surface to one or more detonators positioned within the perforating gun assembly. Passage of such wires through the perforating gun assembly, while maintaining a pressure differential across individual components, has proved challenging.

Assembly of a perforating gun requires assembly of multiple parts, which typically include at least the following components: a housing or outer gun barrel within which is positioned a wired electrical connection for communicating from the surface to initiate ignition, an initiator or detonator, a detonating cord, one or more charges which are held in an inner tube, strip or carrying device and, where necessary, one or more boosters. Assembly typically includes threaded insertion of one component into another by screwing or twisting the components into place, optionally by use of a tandem-sub adapter. Since the wired electrical connection often must extend through all of the perforating gun assembly, it is easily twisted and crimped during assembly. Further, the wired electrical connections, to a detonator or initiator, usually require use of an electrical ground wire connectable to the electrical wire and extending through the housing in order to achieve a ground contact. When a ground contact is desired, the electrical ground wire must also be connected to an often non-defined part of the perforating gun assembly. Thus, the ground wire is sometimes wedged on or in between threads of hardware components and/or twisted around a metal edge of the housing of the perforating gun assembly. One issue with this arrangement is that it can be a source of intermittent and/or failed electrical contact. In addition, when a wired detonator is used it must be manually connected to the electrical wire, which has lead to multiple problems. Due to the rotating assembly of parts, the electrical ground wires can become compromised, that is to say the electrical ground wires can become torn, twisted and/or crimped/nicked, or the wires may be inadvertently disconnected, or even mis-connected in error during assembly, not to mention the safety issues associated with physically and manually wiring live explosives.

According to the prior art and as shown in FIG. 1, a wired bulkhead 10' of the prior art is depicted. In a perforating gun assembly, the bulkhead 10' may be utilized to accommodate electrical and ballistic transfer (via wired electric connection 170', shown with an insulator 172' covering one end of the electrical contact component 20', which extends through the body of the bulkhead 10') to the electric connection of a next gun assembly in a string of gun assemblies, for as many gun assembly units as may be required depending on the location of underground oil or gas formation. Such bulkhead assemblies are usually provided with fixed pin contacts extending from either end of the assembly. Typically the bulkhead is employed to provide the electrical contact or feed-through in order to send electrical signals to the initiator or a type of switching system. In such applications, the pressure bulkhead is required to remain pressure sealed even under high temperatures and pressures as may be experienced in such applications, both during operation and also after detonation of the perforating gun, for instance, so that a neighboring perforating gun or downhole tool device does not become flooded with wellbore fluid or exposed to the wellbore pressure. Maintenance of the pressure differential across such devices occurs via usage of rubber components including o-rings 32', rubber stoppers and the like.

Such bulkhead assemblies are common components, particularly when a string of downhole tools is required, and is a pressure barrier or component through which electronic componentry and/or electrical wiring and electrical ground wiring must pass, (e.g. electric feed-through), and a need exists to provide such componentry with electric feed-through while maintaining a differential pressure across the component, and without compromising the electrical connection.

Improvements to the way electrical connections are accomplished in this industry include connections and arrangements as found in commonly assigned patent applications PCT/EP2012/056609 (in which an initiator head is adapted to easily introduce external wires into the plug without having to strip the wires of insulation beforehand) and PCT/EP2014/065752 (in which a wireless initiator is provided), which are incorporated herein by reference in their entireties.

The assembly described herein further solves the problems associated with prior known assemblies in that it provides, in an embodiment, an assembly that allows improved assembly in the field while maintaining the integrity of the electrical connection, as described in greater detail hereinbelow.

BRIEF DESCRIPTION

In an embodiment, a bulkhead assembly is provided that includes a bulkhead body configured for pressure sealing components positioned downstream of the bulkhead assembly within a downhole tool and to withstand a pressure of at least about 20,000 psi (137.9 mPa) and an electrical contact component extending through the bulkhead body, such that at least a portion of the electrical contact component is configured to pivot about its own axis, wherein the electrical contact component is configured for electrical conductivity and feed-through of an electric signal.

In an embodiment, the electrical contact component includes a plurality of contact pins that are slidably positioned within a bore of the bulkhead body of the bulkhead assembly.

In an embodiment, a ground apparatus is provided to provide an electrical connection for at least one ground wire. The ground apparatus may be positionable on the bulkhead body of the bulkhead assembly.

In an embodiment, a bulkhead assembly in combination with a downhole tool is provided.

BRIEF DESCRIPTION OF THE FIGURES

A more particular description briefly described above will be rendered by reference to specific embodiments thereof that are illustrated in the appended drawings. Understanding that these drawings depict only typical embodiments and are not therefore to be considered to be limiting of its scope, exemplary embodiments will be described and explained with additional specificity and detail through the use of the accompanying drawings in which.

Various features, aspects, and advantages of the embodiments will become more apparent from the following detailed description, along with the accompanying figures in which like numerals represent like components throughout the figures and text. The various described features are not necessarily drawn to scale, but are drawn to emphasize specific features relevant to embodiments.

DETAILED DESCRIPTION

Reference will now be made in detail to various embodiments. Each example is provided by way of explanation, and is not meant as a limitation and does not constitute a definition of all possible embodiments.

A bulkhead assembly is generally described herein, having particular use in conjunction with a downhole tool, and in particular to applications requiring the bulkhead assembly to maintain a pressure, and is thus commonly referred to as a pressure bulkhead assembly. In an embodiment, the bulkhead assembly is configured for use with a logging tool or a perforating gun assembly, in particular for oil well drilling applications. The bulkhead assembly provides an electrical contact component disposed within a body thereof, wherein at least a portion of the electrical contact component is configured to pivot about its own axis, without compromising its ability to provide a pressure and fluid barrier. A ground apparatus is generally described herein. The ground apparatus may have particular utility with various embodiments of the bulkhead assembly described herein. The ground apparatus provides an electrical connection for at least one ground wire and may be configured to pivot about its own axis when positioned on the bulkhead body of the bulkhead assembly, thereby providing continuous and/or successful electrical contact.

Figure 2:
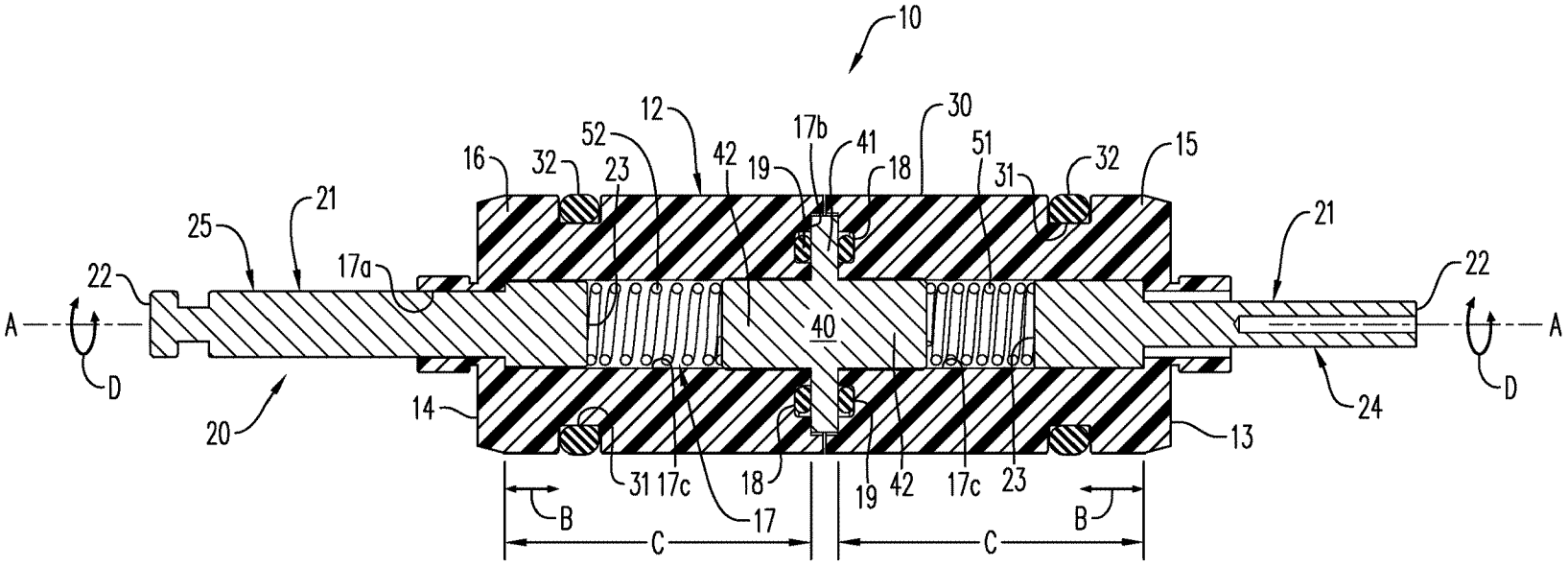
FIG. 2 is a cross-sectional side view of a bulkhead assembly according to an aspect.

With reference to FIG. 2, a bulkhead assembly 10 is provided and is further configured for sealing components positioned downstream of the bulkhead assembly 10 within a downhole tool. In an embodiment, the bulkhead assembly 10 is configured as a pressure-isolating bulkhead and is configured to withstand a pressure of at least about 20,000 psi (137.9 mPa). In an embodiment, the bulkhead assembly 10 is configured to withstand a pressure of at least about 30,000 psi (275.8 mPa). The bulkhead assembly 10 includes a bulkhead body 12 having a first end portion 13 and a second end portion 14 and a bore 17 extending therebetween. It is further envisioned that the bulkhead body 12 includes a first body portion 15 extending from the first end portion 13 towards a center of the bulkhead body 12, and a second body portion 16, extending from the second end portion 14 towards the center of the bulkhead body 12. While it is contemplated that the bulkhead body 12 be made of thermoplastic materials (or otherwise electrically non-conductive materials), it is possible for the bulkhead body 12 to be made of other materials, such as metal (e.g., aluminum with a non-conductive coating). Although the first body portion 15 and the second body portion 16 are depicted as being roughly the same size or otherwise proportioned equally, it is contemplated that these body portions may be dissimilar in size or otherwise disproportionate.

The bulkhead body 12 may be formed as a unitary member or component. Methods of forming the bulkhead body 12 as a unitary member include but are not limited to injection molding and machining the component out of a solid block of material. In an embodiment, the injection molded bulkhead body 12 is formed into a solid material, in which typically a thermoplastic material in a soft or pliable form is allowed to flow around the electrical contact component 20 during the injection molding process.

The bulkhead body 12 includes an outer surface 30, which is configured to be received in a tandem sub 150 as described in greater detail hereinbelow. The outer surface 30 typically includes one or more circumferential indentions 31, which are configured for receiving an outer sealing member 32 in such a way as to seal components positioned downstream of the bulkhead assembly 10 and to withstand typical high pressures experienced in downhole applications.

According to an aspect, the bore 17 extends through the bulkhead body 12, along an axis A-A and typically in the center of the body, and may vary in diameter across the length of the bulkhead body. With particular reference to FIG. 2, the bore 17 may include three sections or portions of varying diameter, although it is possible to configure the bore 17 with one, two, three, or more sections. As depicted in FIG. 2 and in an embodiment, the bore 17 includes an end portion bore 17*a* extending through each of the first body portion 15 and the second body portion 16, a central portion bore 17*b* and mid-portion bores 17*c* extending between the central portion bore 17*b* and the end portion bores 17*a* for a depth or length C. The length C is selected to optimize functionality of the slideable components as described in greater detail hereinbelow. As shown herein and in an embodiment, each end portion bore 17*a* has a smaller radius than the respective mid-portion bore 17*c*, while the central portion bore 17*b* has a larger radius than the mid-portion bores 17*c*.

The bulkhead assembly 10 further includes an electrical contact component 20 extending through the bore 17 of the bulkhead body 12, such that at least a portion of the electrical contact component 20 is configured to pivot about its own axis A-A. Thus, the bulkhead assembly 10 has a pivotable electrical contact component 20. The electrical contact component 20 is configured for electrical conductivity and feed-through of an electric signal. The electrical contact component 20 may thus be formed of any suitable electrically conductive material.

The electrical contact component 20 may include one or more of the following components: a contact pin 21 or wire (not shown), a biasing member 50 (FIG. 3), and/or a central portion 40. It will be understood by one of ordinary skill in the art that although terms like "central" are utilized, such terms are used to describe the positions of some components relative to other components. Although the component may literally be positioned centrally, it is also contemplated that positioning of the components may be de-centralized without detracting from the intended purpose.

Figure 1:
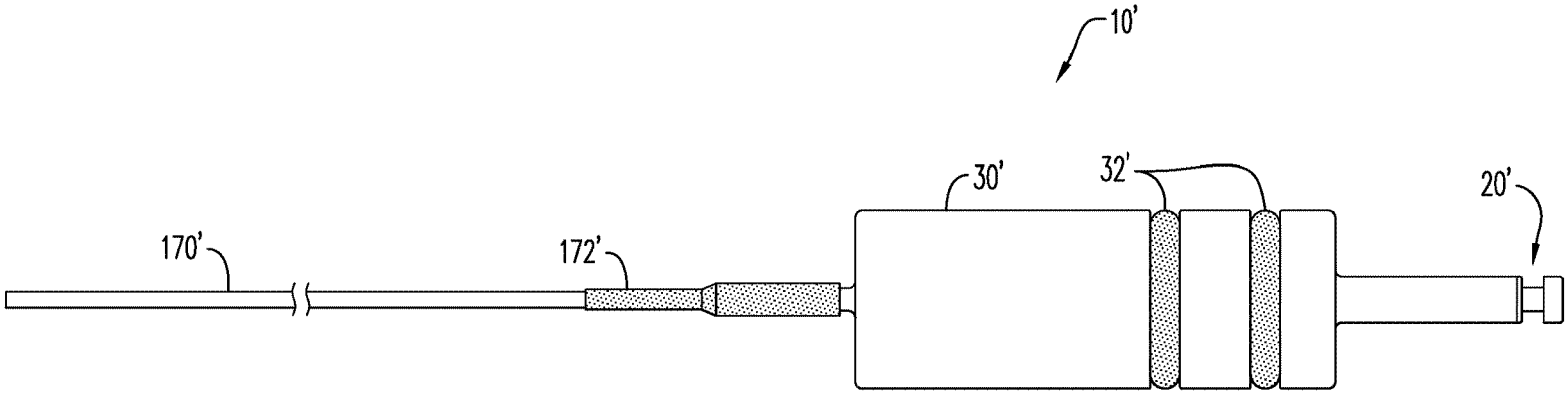
FIG. 1 (PRIOR ART)
FIG. 1 is a perspective view of a bulkhead assembly according to the prior art.

In an embodiment and with particular reference to FIGS. 1 and 2, the electrical contact component 20 includes one or more contact pins 21, a wire connection (not shown) or combinations thereof. In other words, it may be possible to assemble the bulkhead assembly 10 according to an aspect in which a contact pin 21 is replaced by the wire at, for instance a first end 22. Although this may limit the adaptability for the intended use, that is to freely pivot within the bulkhead to avoid binding, crimping or otherwise compromising the wire (and thus an electrical signal), having a single pivotable electrical contact component extending from an end of the bulkhead assembly 10 may still be advantageous over currently available assemblies.

According to an aspect, the electrical contact component 20 may include a plurality of contact pins 21, and each of the contact pins 21 include the first end 22 and a second end 23. In an embodiment, at least one of the contact pins 21 is slidably positioned within the bore 17 of the bulkhead body 12. In an embodiment, the contact pin includes a pin head 26 extending from a pin body 27. Typically, the contact pin may include a terminal contacting portion 28 extending from the pin body 27, opposite the pin head 26 for ease of facilitating the electrical connection.

Figure 3:
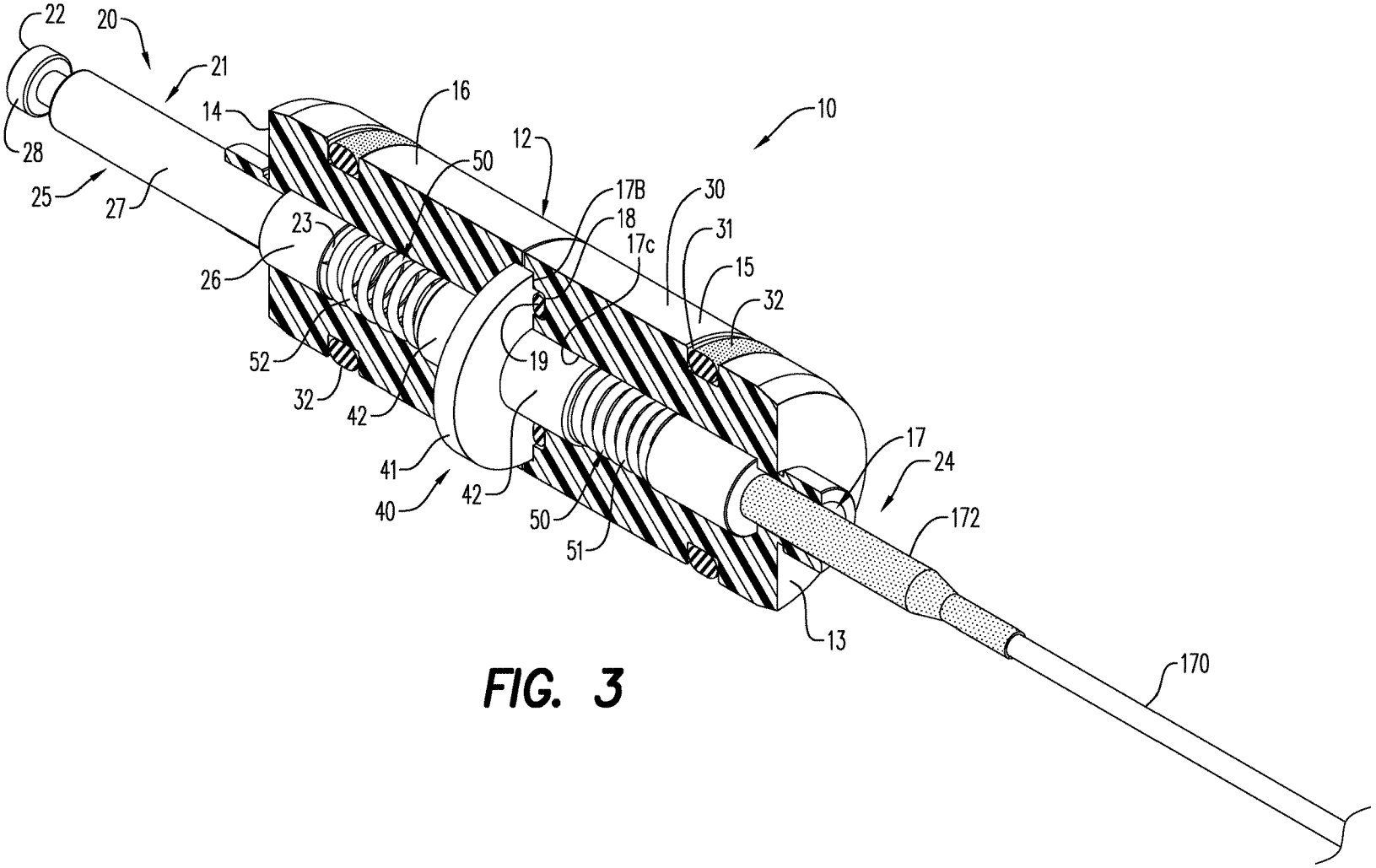
FIG. 3 is a cut-away perspective view of the bulkhead assembly of FIG. 2.

As shown in FIGS. 2 and 3, the bulkhead assembly 10 of the depicted embodiment includes a first contact pin 24 positioned at least partially within the first body portion 15 and extending from the first end portion 13 to an exterior or outer surface 30 of the assembly 10, while a second contact pin 25 is positioned at least partially within the second body portion 16 and extends from the second end portion 14 to the outer surface 30 of the assembly 10.

In an embodiment, the central bore portion 17*b* is typically configured to receive the central portion 40 of the electrical contact component 20, while a mid-portion bore 17*c* is typically configured to receive the pin head 26 and/or the biasing members 50 of the electrical contact component 20. In an embodiment, the central portion 40 and a plurality of biasing members 50 (such as a coil spring) are positioned within the bore 17 of the bulkhead body 12 with the biasing members abutting at least a portion of the central portion 40. In an embodiment, the central portion 40 of the electrical contact component 20 includes a disk-like central body 41 and arms 42 extending therefrom.

As depicted in FIGS. 2 and 3 and in an embodiment, the central portion bore 17*b* of the bore 17 includes a recessed portion 18, which is recessed from the central portion bore and configured to receive a bore sealing member 19. This seal will help to maintain the integrity of the bulkhead assembly 10 for sealing and maintaining pressure across the assembly as described in greater detail hereinbelow.

As shown herein, the plurality of biasing members 50 include a first biasing member 51 and a second biasing member 52. The first biasing member 51 is positioned within the bore 17 of a first body portion 15 of the bulkhead body 12, and the second biasing member 52 is positioned within the bore 17 of a second body portion 16 of the bulkhead body 12. More particularly and in this embodiment, the biasing members 50 are positioned within the mid-portion bore 17*c*. In a further embodiment, the plurality of biasing members 50 abut the central portion 40, and each of said biasing members 50 abuts at least one of the contact pins 21. In an embodiment, the first contact pin 24 abuts the first biasing member 51 and the second contact pin 25 abuts the second biasing member 52. It is further contemplated that it is possible to provide a rigid connection between at least one of the first contact pin 24 and the first biasing member 51 or the second contact pin 25 and the second biasing member 52.

According to an aspect, the pin head 26 of the contact pin is sized to be slidably received within the mid-portion bore 17*c* of the bore 17 of the bulkhead body 12. Thus, in a typical arrangement, the pin head 26 may have an enlarged radius relative to the radius of the pin body 27. In this way, the pin head 26 will be received within the mid-portion 17*c*, while the pin body 27 extends through the end portion bore 17*a* of the first or second end portion 13, 14, respectively.

In operation, the contact pins 21 are capable of rotation or swiveling or twisting or pivoting, (all of which are functions referred to generically herein as "pivot," "pivotable," "pivoting"), about its own axis A-A as shown by arrows D, and are rotatable or pivotable in either direction. This ability to pivot, or to be pivotable, about its own axis can be very useful during the loading procedure of hardware of a downhole tool 100 such as a perforating gun assembly where the twisting of the electrical cable attached to the bulkhead assembly 10 (typically crimped or soldered) would otherwise cause the cable connection to snap off unintentionally. The pivot function described herein allows at least portions of the electrical contact component 20 to pivot without building up tension in the cable to a point of snapping. In addition, the biasing members 50 may also compensate for unfavorable tolerance stack-up in the perforating gun assembly 100.

As shown herein, the axis A-A of the contact pins 21 coincides with the axis A-A of the bulkhead body 12. Furthermore, the contact pins 21 are capable of sliding backwards and forwards in the direction shown by arrows B, and such movement is limited by biasing members 50. In practice, the contact pin is capable of moving into and out of the body while restricted from leaving the bulkhead body 12 due to the smaller inner diameter of end portion bores 17*a*, and compressibility of biasing members 50 as the members 50 are pushed against the central portion 40. It is anticipated that a thickness of each of the first end portion 13 and the second end portion 14 are sized sufficiently to stop or retain at least a portion of the contact pin 21, and in an embodiment, to stop or retain the pin head 26 within the mid-portion bore 17*c*. Alternatively, it may be possible to fix or otherwise attach (rather than abut) each of the components of the electrical contact component 20 together (not shown). In other words, on one end of the electrical contact component 20, the first contact pin 24 may be attached to the first biasing member 51, which is attached to the central portion 40, while at the other end of the component, the second contact pin 25 may be attached to the second biasing member 52, which is attached to the central portion 40. In this way, it may not be necessary to provide first end portion 13 and second end portion 14 to retain the assembly within the bulkhead body 12.

Figure 5:
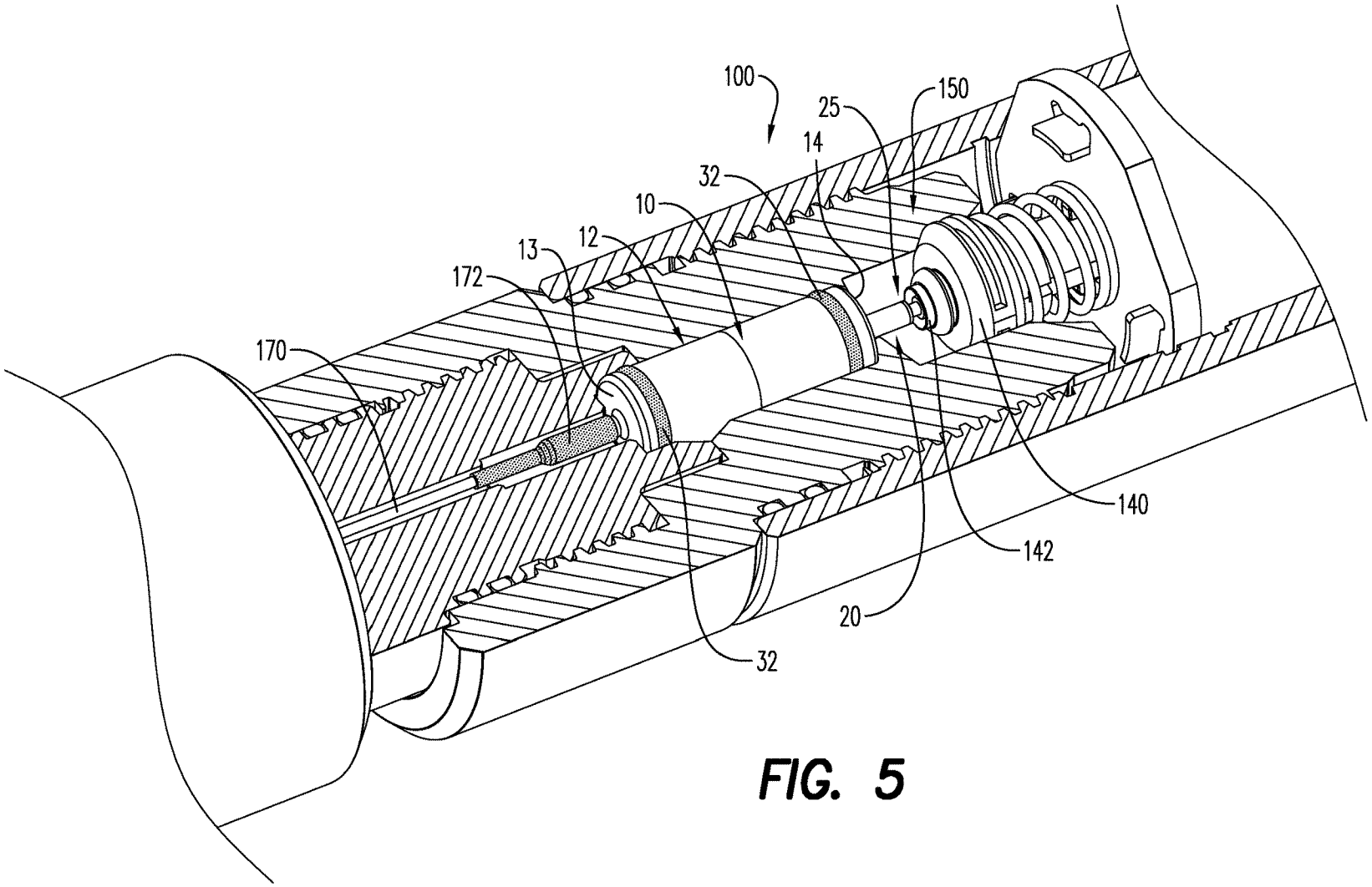
FIG. 5 is a partially cut-away perspective view of the bulkhead assembly assembled within a perforating gun assembly according to an aspect.

In an embodiment, the bulkhead assembly 10 is able to maintain a higher pressure at the first end portion 13 of the bulkhead body 12 as compared to the second end 14 of the bulkhead body 12, as depicted in an embodiment in, for instance, FIG. 5. In this embodiment, the bulkhead assembly 10 is positioned within the downhole tool 100, in this instance a perforating gun assembly. Any and all of the features of the bulkhead assembly 10 mentioned hereinabove are useful in the downhole tool 100 including the bulkhead assembly 10.

Only a portion of the downhole tool 100 is depicted herein, including a tandem seal adapter or tandem sub 150, in which the bulkhead assembly 10 is shown assembled within the perforating gun assembly 100. In an embodiment, the bulkhead assembly 10 is configured for positioning within the tandem seal adaptor 150. The tandem sub 150 is configured to seal inner components within the perforating gun housing from the outside environment using various sealing means. The tandem seal adapter 150 seals adjacent perforating gun assemblies (not shown) from each other, and houses the bulkhead assembly 10. As shown herein, the wired electrical connection 170 is connected to the first end 22 of the electrical contact component 20 of the bulkhead assembly 10 via the first contact pin 24 (not shown). An insulator 172 covers the first contact pin 24 and in an embodiment provides a coating or insulating member, typically using heat shrinking, over the connecting wires of the wired electrical connection 170.

Figure 4:
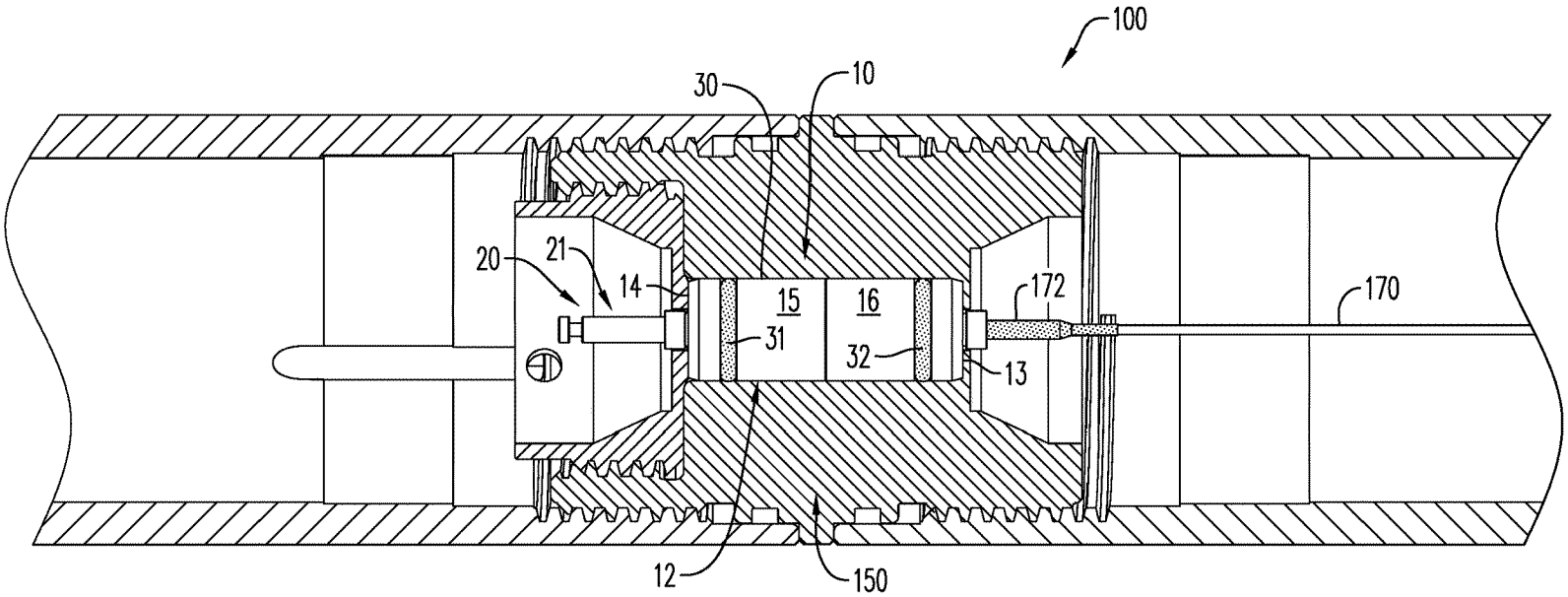
FIG. 4 is a partially cut-away side view of the bulkhead assembly assembled within a perforating gun assembly according to an aspect.

In an embodiment, and as shown particularly in FIGS. 4 and 5, the bulkhead assembly 10 functions to relay the electrical signal via the electrical contact component 20 to an initiator 140, such as a detonator or igniter. In particular and as shown in FIG. 5, the second contact pin 25 is in contact with a spring loaded electric contact, which is connected to the initiator 140. In an embodiment and as shown herein, the first contact pin 24 (see, for instance, FIG. 2, and which is covered by the insulator 172 in FIG. 5) is configured for connecting to the wired electrical connection 170 and the second contact pin 25 is configured for wirelessly electrically contacting an electrical contact, such as a detonator electrical contacting component 142, to transmit the electrical signal. In a further embodiment, the second contact pin 25 is configured for wirelessly electrically contacting an electrical contact of the initiator 140.

Figure 6:
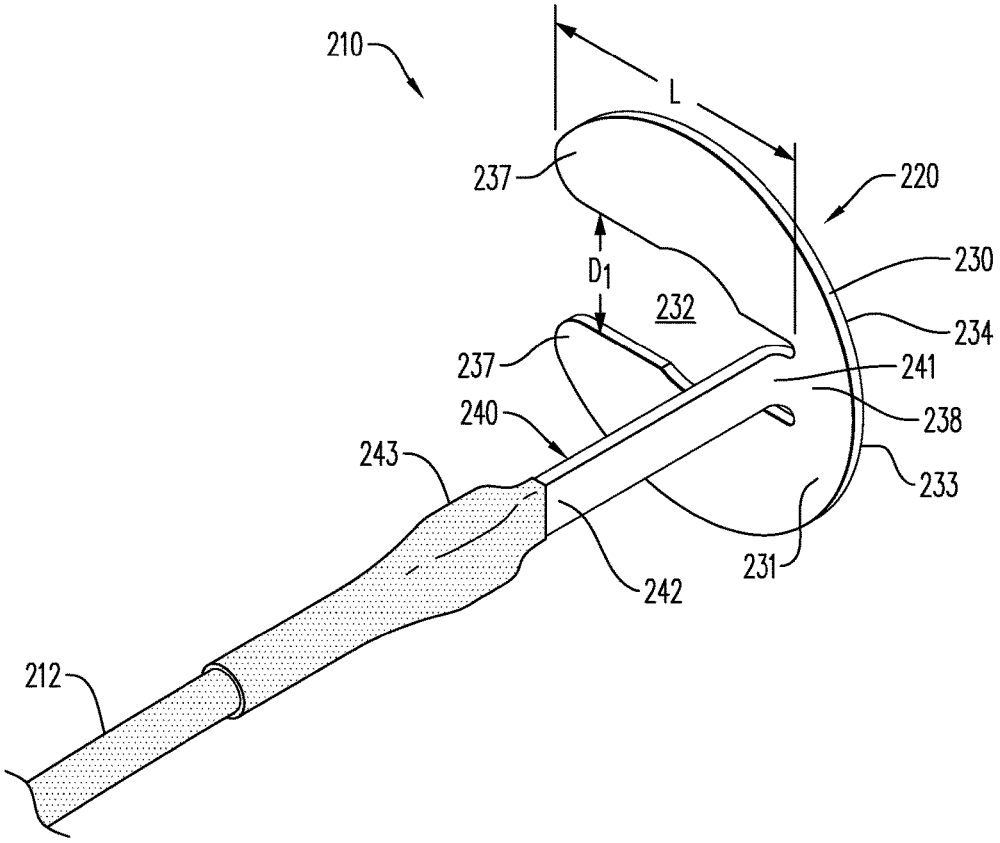
FIG. 6 is a perspective view of a ground apparatus according to an aspect.
Figure 7:
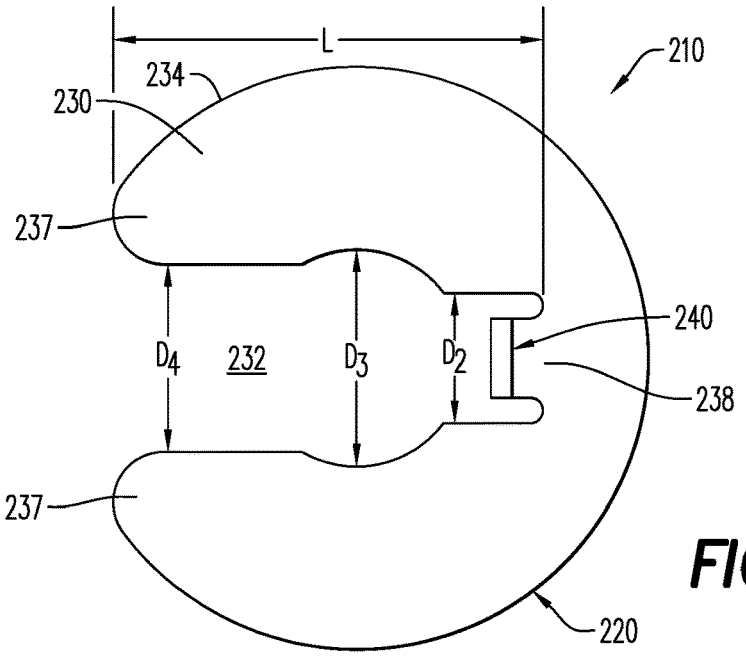
FIG. 7 is a top view of a ground apparatus according to an aspect.
Figure 9A:
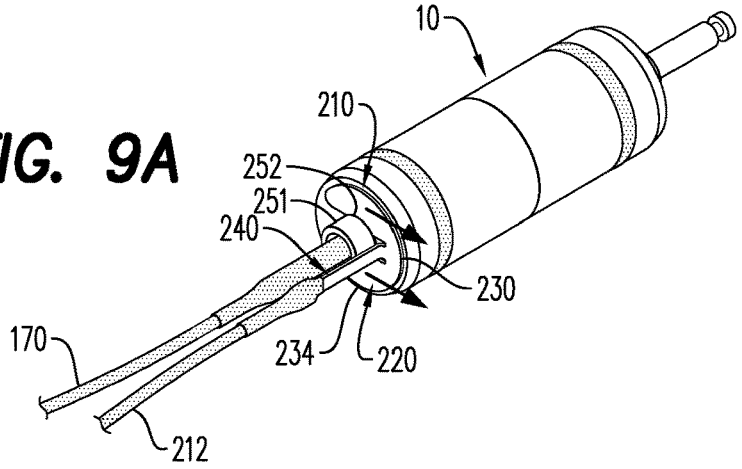
FIGS. 9A-9C are perspective views showing a ground apparatus positioned on a bulkhead assembly according to an aspect.
Figure 9B:
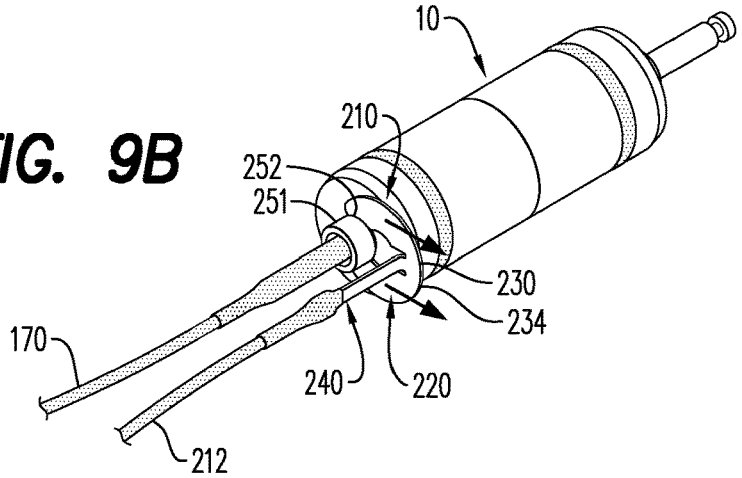
Figure 9C:
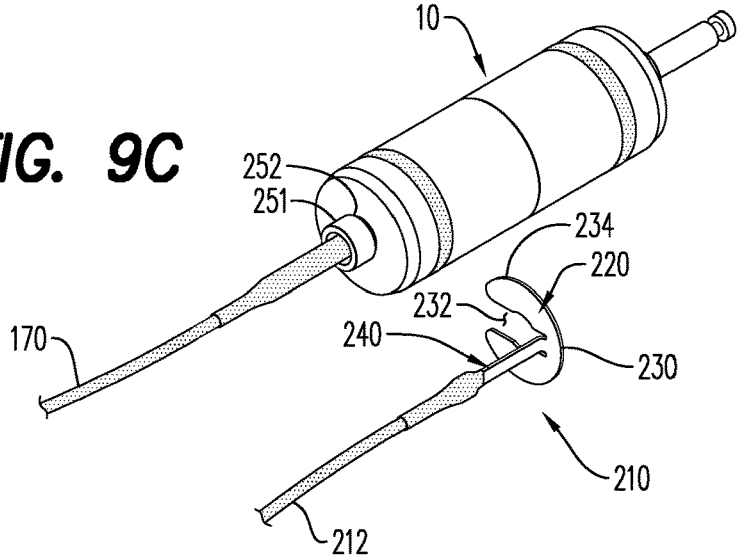

With reference to FIGS. 6-7, a ground apparatus 210 is provided and is configured for providing an electrical connection for at least one ground wire 212. According to an aspect, the ground apparatus may be configured to be received by a receiving member 251 (substantially as shown in FIGS. 9A-9C and described substantially hereinbelow). The ground apparatus 210 may provide a ground apparatus to the electrical contact component of the bulkhead assembly 10 by providing a simple means to ground/attach the ground wire 212. (See, for instance, FIGS. 10-13.)

Figure 12:
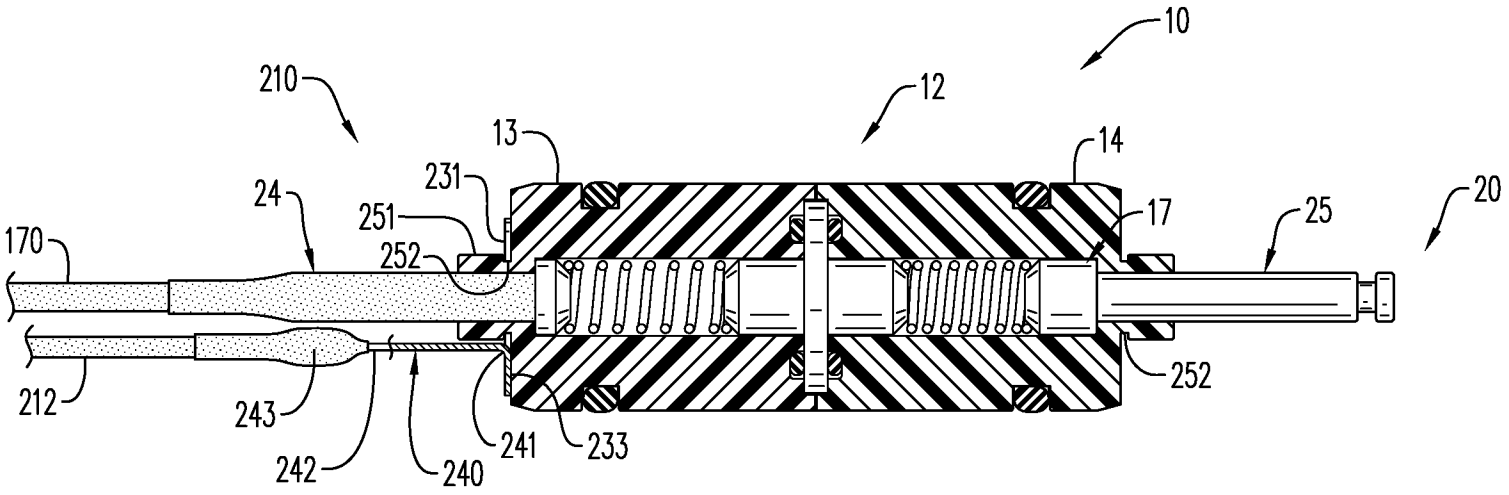
FIG. 12 is a cross-sectional view of a bulkhead assembly having a ground apparatus according to an aspect.

According to an aspect, the ground apparatus 210 may include a plate 220 and a contact arm 240 extending from the plate 220. The plate 220 may include a grounding body 230 including an upper surface 231 and a lower surface 233. According to an aspect, the ground apparatus 210 includes a contact arm 240, which may be formed integrally with and extend from the grounding body 230. While FIG. 6 and FIG. 12 illustrates the contact arm 240 extending out of or away from the upper surface 231, it is to be understood that in some embodiments, the contact arm 240 extends out of or away from the lower surface 233. The contact arm 240 may include an inner portion 241 and an outer portion 242, such that the inner portion 241 extends from the base 238 of the grounding body 230 and the outer portion 242 extends beyond the inner portion 241. The outer portion 242 of the contact arm 240 may include a connecting means 243 for mechanically and electrically connecting to the ground wire 212, thereby providing an electrical ground connection. The connecting means 243 may include, for example, plastic sheathing cables, electrical tape, a clip and insulator, and the like.

According to an aspect and as illustrated in FIG. 7, the plate 220 of the ground apparatus 210 includes at least a semi-disc shape. The plate 220 may have any other shape, such as a rectangular shape. According to an aspect, the plate 220 includes a ductile bendable sheet metal having conductive properties. In an embodiment, the plate 220 includes aluminum, copper, copper alloys and or any other electrically conductive materials. According to an aspect, the contact arm 240 is formed integrally with the grounding body 230 by virtue of being formed from the partially cut or stamped-out section of the grounding body 230.

The grounding body 230 may include an aperture 232. As illustrated in FIG. 7, the grounding body 230 may include the aperture 232 extending from a perimeter 234 of the grounding body 230 substantially inwards and substantially towards a central portion of the grounding body 230. The arrangement and/or formation of the aperture 232 in the grounding body 230 may form fingers 237 on either side of the grounding body 230. The fingers 237 may extend from a base 238 of the grounding body 230. According to an aspect, the fingers 237 extend substantially from the base 238 towards the perimeter 234 of the grounding body 230. In an embodiment, the length L of the fingers 237 defines the depth of the aperture 232 and is the distance from the base 238 of the grounding body 230 to the perimeter 234. The length L may be of any size and shape that would enable the fingers 237 to engage with the receiving member 251, as will be discussed in greater detail hereinbelow. According to an aspect, a distance D1 defines the width of the aperture 232, between the fingers 237. In an embodiment, the distance D1 is created by virtue of the stamped out section of the grounding body 230, i.e., the D1 is substantially same as a size and/or dimensions of the contact arm 240.

With particular reference to FIG. 7, the distance D1 may include an inner distance D2, a central distance D3 and an outer distance D4. According to an aspect, the central distance D3 may have a larger size than the inner distance D2 and/or the outer distance D4. According to an aspect, the central distance D3 may be sized and adapted to provide the pivoting capabilities of the ground apparatus 210. In an embodiment, the central distance D3 is designed to have a substantially circular shape. According to an aspect, when the outer distance D4 is smaller in size than the central distance D3, the outer distance D4 provides retention capabilities when the ground apparatus 210 is snapped or otherwise positioned on, for example, the bulkhead assembly 10 and/or engaged with the receiving member 251, as seen, for instance, in FIG. 9A.

Figure 8:
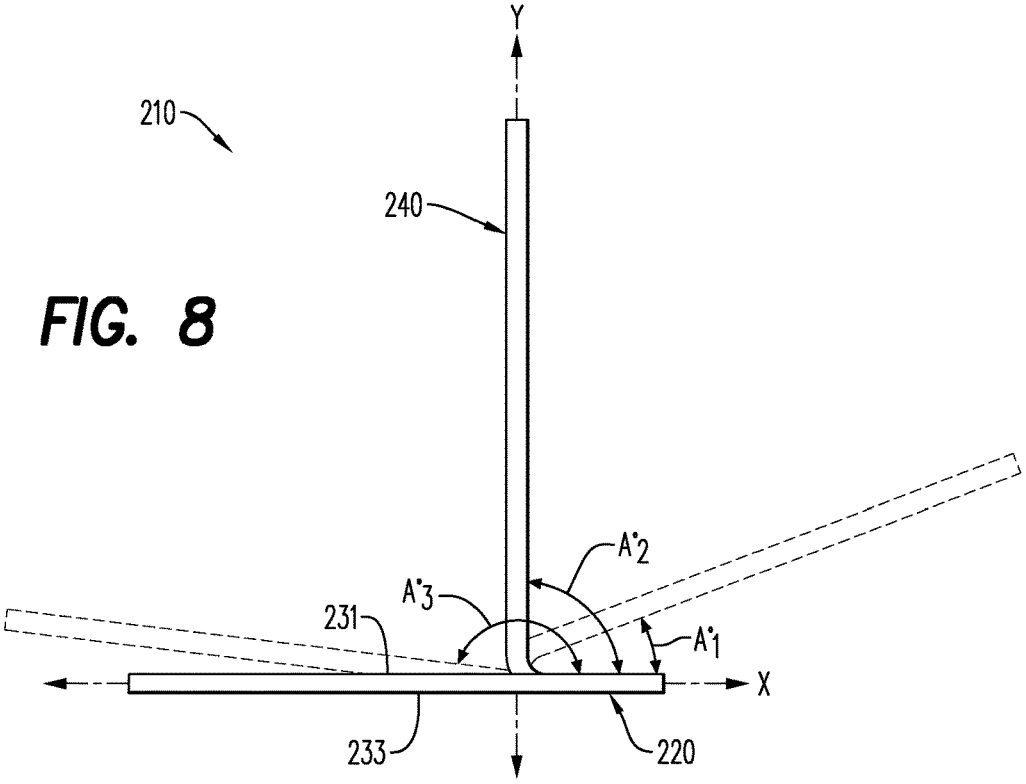
FIG. 8 is a side view of a ground apparatus according to an aspect.

As illustrated in FIG. 8, the contact arm 240 extends from the plate 220, and thus is positioned away from the upper surface 231 of the grounding body 230. According to an aspect, the contact arm 240 projects away from the plate 220 at an angle A°. The angle A° may be between about 10 degrees $A°_1$ and about 170 degrees $A°_3$. According to an aspect, the angle A° is between about 10 degrees $A°_1$ and about 90 degrees $A°_2$. As described hereinabove, the grounding body 230 may be configured for pivoting about its own axis when positioned on the electrical device and/or the receiving member 251. In any event, the angle A° may be selected so that when the grounding body 230 pivots about its own axis, the ground wire 212 will not be torn, twisted and/or crimped/nicked, i.e., the ground wire 212 will not become compromised. In other words, the grounding apparatus 210 may be able to provide continuous and/or successful electrical connection for the ground wire 212 while also being pivotable on the bulkhead assembly 10 and/or the receiving member 251, thereby helping to at least reduce and/or limit the safety issues associated with physically and manually wiring live explosives.

As illustrated in FIGS. 9A-9C and according to an aspect, the ground apparatus 210 is removeably positioned on the receiving member 251 of the bulkhead assembly 10. According to an aspect, the grounding body 230 is at least partially positioned in a groove 252 formed in the receiving member 251. When positioned in the groove 252, the grounding body 230 is pivotable about its own axis. In an embodiment, when the grounding wire 212 is attached to the contact arm 240 of the ground apparatus, the ground apparatus 210 is pivotable in such a manner that the grounding wire 212 will not become compromised. Further, by virtue of being attached to the ground apparatus 210, the grounding wire 212 is also capable of being removeably positioned and/or connected to the receiving member 251.

According to an aspect and as illustrated in FIGS. 9A-9B, when the ground apparatus 210 is positioned on the receiving member 251, the perimeter 234 of the grounding body 230 may have a shape that is substantially similar to the shape of the bulkhead assembly 10. In some embodiments, the perimeter 234 of the grounding body 230 has a shape that is not similar to the shape of the bulkhead assembly 10 (not shown).

FIGS. 9A-9C illustrate the ground apparatus 210 being removed from the receiving member 251, according to an aspect. When the ground apparatus 210 is removed from the receiving member, it can be easily repositioned thereon without requiring additional devices, such as, for example, clips and/or fasteners. The grounding apparatus 210 may function as an integrated device having all the components required for providing continuous and/or successful electrical contact.

With reference to FIGS. 10-13 and according to an aspect, a bulkhead assembly 10 having an integrated ground apparatus is provided. The bulkhead assembly 10 is illustrated including a bulkhead body 12 and an electrical contact component 20. According to an aspect, the bulkhead body 12 includes a first end portion 13, a second end portion 14 and a bore 17 (see FIG. 12) extending between the first end portion 13 and the second end portion 14. The electrical contact component 20 may extend through the bore 17 of the bulkhead body 12, such that at least a portion of the electrical contact component 20 is configured to pivot about its own axis. According to an aspect, the electrical contact component 20 is configured for electrical conductivity and feed-through of the electric signal.

Figure 10:
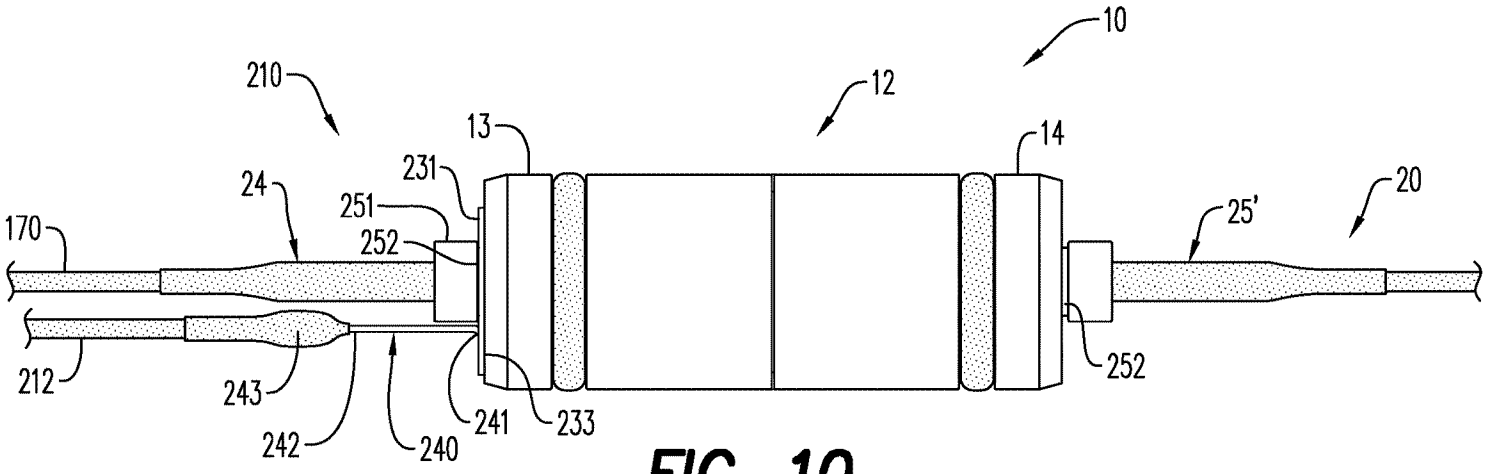
FIG. 10 is a side view of a ground apparatus positioned on a bulkhead assembly for use with a wired initiator, according to an aspect.
Figure 11:
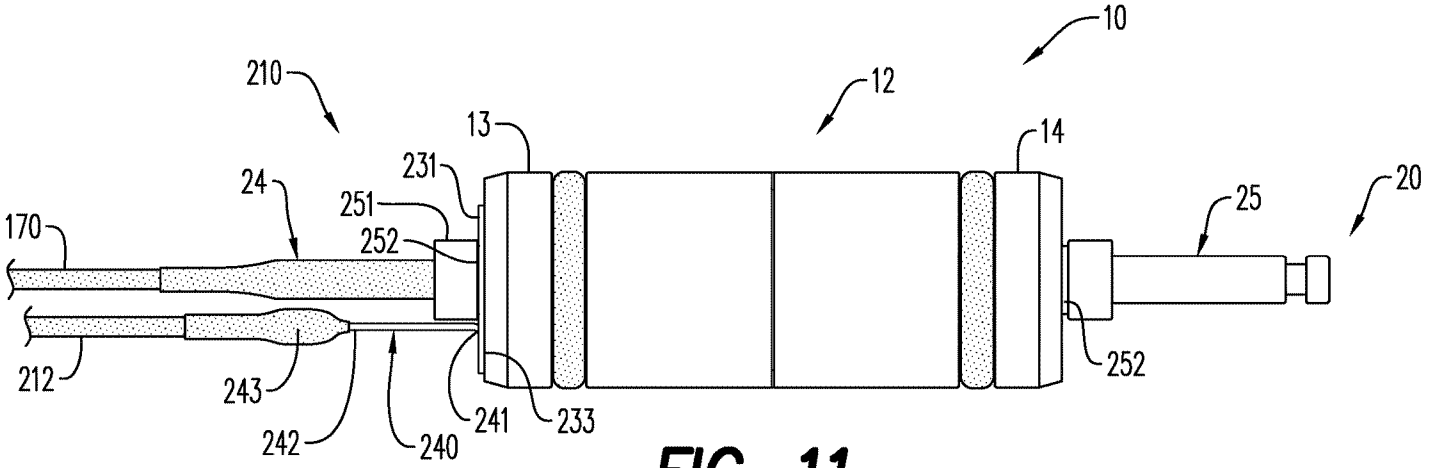
FIG. 11 is a side view of a ground apparatus positioned on a bulkhead assembly for use with a wireless initiator, according to an aspect.

With reference to FIGS. 10-11 and according to an aspect, the bulkhead assembly 10 includes the first contact pin 24 extending from the first end portion 13 and the second contact pin 25, 25' extending from the second end portion 14, with the ground apparatus 210 positioned adjacent to the first end portion 13 of the bulkhead body 12. According to an embodiment, and as illustrated in FIG. 10, the first contact pin 24 is configured for connecting to the wired electrical connection 170 and the second contact pin 25' is configured for providing a wired electrical connection to, for instance, a wired initiator (not shown), to transmit the electrical signal. In an alternative embodiment and as illustrated in FIG. 11, the first contact pin 24 is configured for connecting to the wired electrical connection 170 and the second contact pin 25 is configured for providing a wireless electrical connection to the wireless detonator electrical contacting component 142, (see, for instance, FIG. 5), to complete the electrical connection and to transmit the electrical signal. According to an aspect, when the ground apparatus 210 is positioned within the groove 252 formed in the receiving member 251, the ground apparatus 210 can rotate/swivel/pivot about the receiving member 251 in a manner that does not compromise the grounding wire 212. According to an aspect, the pivot function of the ground apparatus 210 relative to the bulkhead assembly 10 prevents the grounding wire 212 from becoming torn, crimped/nicked, inadvertently disconnected from the receiving member 251, and allows the ground apparatus 210 to pivot or twist around the receiving member 251 as the electrical contact component 20 pivots within the bulkhead body 12 of the bulkhead assembly 10.

Figure 13:
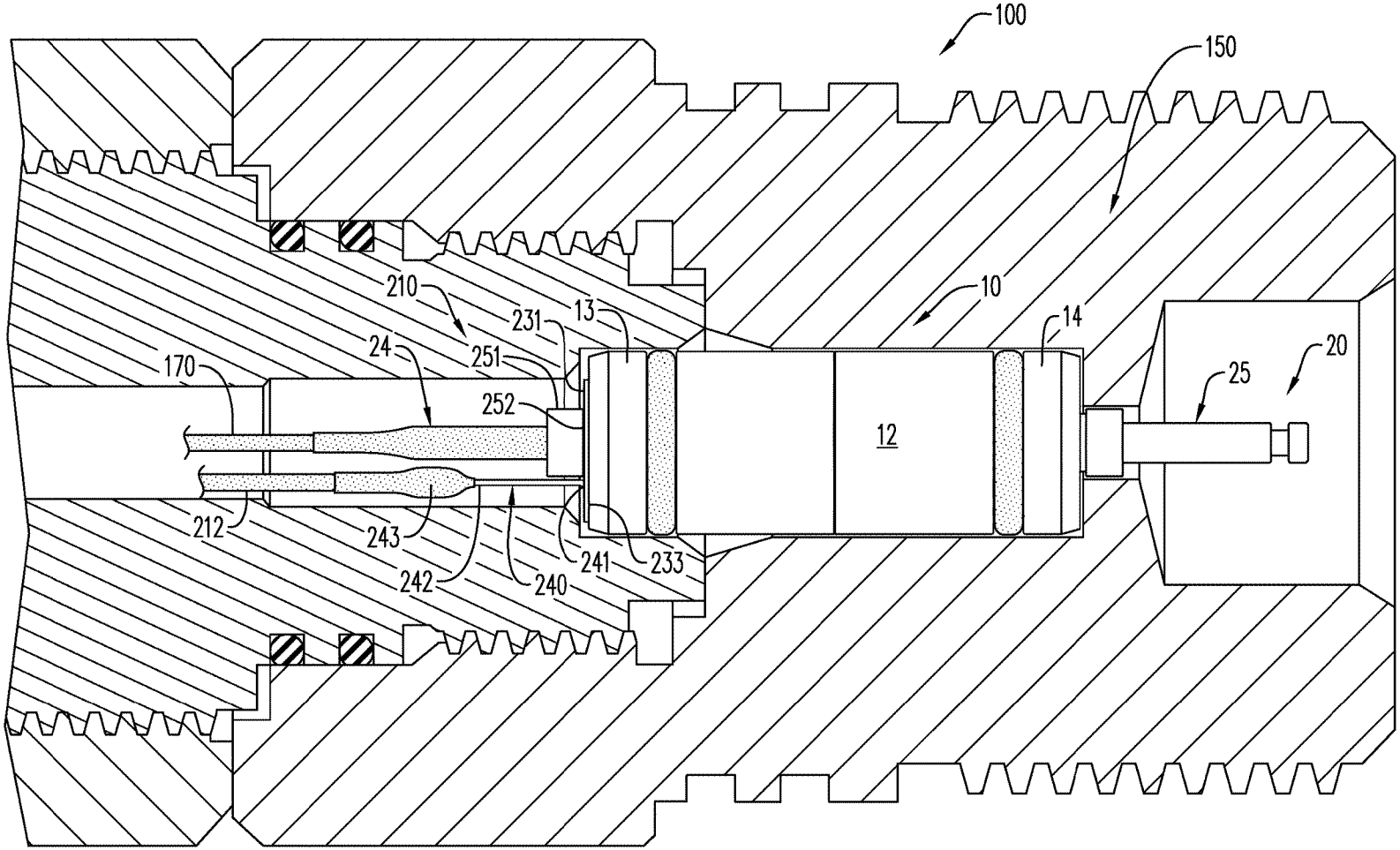
FIG. 13 is a partially cut-away side view a bulkhead assembly having a ground apparatus and assembled within a perforating gun assembly according to an aspect.

FIG. 13 illustrates a downhole tool 100 including the bulkhead assembly 10 having the integrated ground apparatus 210, according to an aspect. The downhole tool 100 may include the tandem seal adapter 150 (FIG. 4) and the ground apparatus 210 pivotally attached to or assembled on the bulkhead assembly 10 within the tandem seal adapter 150, in such a manner that the inner components within the bulkhead assembly 10 are sealed within the tandem seal adapter 150. In other words, the tandem seal adapter 150 may house and seal the bulkhead assembly 10 and its respective ground apparatus 210 from adjacent perforating gun assemblies (not shown).

In an embodiment, the bulkhead assembly 10 provides an improved apparatus for use with a wireless connection—that is, without the need to attach, crimp, cut or otherwise physically and manually connect external wires to the component. Rather, one or more of the connections may be made wirelessly, by simply abutting, for instance, electrically contactable components. For the sake of clarity, the term "wireless" does not refer to a WiFi connection, but rather to this notion of being able to transmit electrical signals through the electrical componentry without connecting external wires to the component.

In an embodiment, the bulkhead assembly 10 is provided that is capable of being placed into the downhole tool 100 with minimal effort. Specifically, bulkhead assembly 10 is configured for use in the downhole tool 100 and to electrically contactably form an electrical connection with the initiator 140 or other downhole device, for instance, to transmit the electrical signal without the need of manually and physically connecting, cutting or crimping wires as required in a wired electrical connection.

The components and methods illustrated are not limited to the specific embodiments described herein, but rather, features illustrated or described as part of one embodiment can be used on or in conjunction with other embodiments to yield yet a further embodiment. Such modifications and variations are intended to be included. Further, steps described in the method may be utilized independently and separately from other steps described herein.

While the apparatus and method have been described with reference to preferred embodiments, it will be understood by those skilled in the art that various changes may be made and equivalents may be substituted for elements thereof without departing from the scope. In addition, many modifications may be made to adapt a particular situation or material to the teachings without departing from the essential scope thereof. In the interest of brevity and clarity, and without the need to repeat all such features, it will be understood that any feature relating to one embodiment described herein in detail, may also be present in an alternative embodiment. As an example, it would be understood by one of ordinary skill in the art that if the electrical contact component 20 of one embodiment is described as being formed of an electrically conductive material, that the electrical contact component 20 described in the alternative embodiment is also formed of an electrically conductive material, without the need to repeat all such features.

In this specification and the claims that follow, reference will be made to a number of terms that have the following meanings. The singular forms "a," "an" and "the" include plural referents unless the context clearly dictates otherwise. Furthermore, references to "one embodiment" are not intended to be interpreted as excluding the existence of additional embodiments that also incorporate the recited features. Terms such as "first," "second," etc. are used to identify one element from another, and unless otherwise specified are not meant to refer to a particular order or number of elements.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

As used in the claims, the word "comprises" and its grammatical variants logically also subtend and include phrases of varying and differing extent such as for example, but not limited thereto, "consisting essentially of" and "consisting of."

Advances in science and technology may make equivalents and substitutions possible that are not now contemplated by reason of the imprecision of language; these variations should be covered by the appended claims. This written description uses examples, including the best mode, and also to enable any person of ordinary skill in the art to practice, including making and using any devices or systems and performing any incorporated methods. The patentable scope is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

What is claimed is:

1. A bulkhead assembly comprising:

a bulkhead body having a first end portion, a second end portion and a bore extending between the first end portion and the second end portion;

an electrical contact component extending through the bore of the bulkhead body and configured for electrical conductivity through the bulkhead body, the electrical contact component including an arm portion contained inside the bulkhead body, wherein the bulkhead body, the electrical contact component and the bore have a common longitudinal axis, and the bulkhead body is configured to pivot relative to the electrical contact component; a disk portion contained inside the bulkhead body and attached to the arm portion; and a ground wire attached to the bulkhead body.

2. The bulkhead assembly of claim 1, wherein a substantial portion of the electrical contact component is slidably disposed within the bore of the bulkhead body.

3. The bulkhead assembly of claim 2, wherein the electrical contact component further comprises:

a contact pin portion having a first radius;

a pin head portion positioned within the bore of the bulkhead body, the pin head portion having a second radius greater than the first radius of the contact pin portion; and a biasing member abutting the pin head portion and positioned within the bore of bulkhead body.

4. The bulkhead assembly of claim 3, wherein the biasing member urges the pin head away from the first end portion of the bulkhead body and toward the second end portion of the bulkhead body.

5. The bulkhead assembly of claim 3, wherein the bore comprises an end portion bore extending through second end portion, wherein the end portion bore has an end portion bore radius that is smaller than a radius of the bore extending between the first end portion and the second end portion.

6. The bulkhead assembly of claim 5, wherein the first radius of the contact pin is less than the end portion bore radius; and the second radius of the pin head is greater than the end portion bore radius.

7. The bulkhead assembly of claim 5, wherein the second radius of the pin head is sized to be slidably received within the bore of the bulkhead body.

8. A bulkhead assembly comprising:

a bulkhead body having a first end portion, a second end portion and a bore extending between the first end portion and the second end portion;

an electrical contact component comprising a contact pin portion connected to a leg portion, the leg portion slideably disposed within the bore of the bulkhead body, and the electrical contact component configured for conducting electricity through the bulkhead body, wherein the bulkhead body, electrical contact component and bulkhead body bore have a common longitudinal axis; a disk portion contained inside the bulkhead body and attached to the leg portion, the disk portion having a radius greater than the radius of the contact pin portion; and a ground wire attached to the bulkhead body.

9. The bulkhead assembly of claim 8 wherein the bulkhead body and the electrical contact component may pivot relative to one another about the common longitudinal axis.

10. The bulkhead assembly of claim 8, wherein the contact pin is disposed through the second end portion of the bulkhead body.

11. The bulkhead assembly of claim 8, further comprising:

a biasing member positioned within the bore of the bulkhead body and abutting the leg portion.

12. The bulkhead assembly of claim 11, wherein the biasing member exerts a biasing force on the disk portion away from the first end portion of the bulkhead body and toward the second end portion of the bulkhead body.

13. The bulkhead assembly of claim 8, wherein the bore comprises an end portion bore extending through second end portion, an end portion bore radius that is smaller than a radius of the bore extending between the first end portion and the second end portion.

14. The bulkhead assembly of claim 13, wherein the radius of the contact pin is less than the end portion bore radius; and the radius of the disk is greater than the end portion bore radius.

15. The bulkhead assembly of claim 8, further comprising:

a wire extending through the first end portion of the bulkhead body and attached to the electrical contact component.

16. The bulkhead assembly of claim 15, further comprising:

an insulator between the wire and the first end portion of the bulkhead body.

17. A bulkhead assembly comprising:

a bulkhead body having a first end portion, a second end portion and a bore extending between the first end portion and the second end portion, wherein the bore has a bulkhead body bore radius;

a second end portion bore extending through the second end portion and having a second end portion bore radius; and an electrical contact component configured for electrical conductivity through the bulkhead body, the electrical contact component having a contact pin portion connected to a pin head portion, wherein a radius of the pin head portion is greater than a radius of the contact pin portion, wherein the radius of the pin head portion is smaller than the bulkhead body bore radius and larger than the second end portion bore radius, and the radius of the contact pin is smaller than the second end portion bore radius, the bulkhead body bore, the second end portion bore, the contact pin portion and the pin head portion each have a common longitudinal axis, the pin head portion is slideably disposed in the bulkhead body bore and the contact pin portion extends from the pin head portion and is slideably disposed through the second end portion bore, and the bulkhead body is configured to pivot about the common longitudinal axis relative to the electrical contact component.

18. The bulkhead assembly of claim 17, further comprising:

a biasing member positioned within the bulkhead body bore and abutting the pin head portion.

19. The bulkhead assembly of claim 18, wherein the biasing member urges the pin head away from the first end portion of the bulkhead body and towards the second end portion of the bulkhead body.

20. The bulkhead assembly of claim 17, further comprising at least one of:

a ground wire attached to the bulkhead body; and a wire extending through the first end portion of the bulkhead body and attached to the electrical contact component.

* * * * *